US010751726B2

(12) United States Patent
Johnston et al.

(10) Patent No.: US 10,751,726 B2
(45) Date of Patent: Aug. 25, 2020

(54) MATERIAL PROCESSING APPARATUS WITH ROTOR CONTROL SYSTEM

(71) Applicant: Terex GB Limited, Dungannon, County Tyrone (GB)

(72) Inventors: Lee Johnston, Lisbellaw (GB); Richard Byrne, Dungannon (GB)

(73) Assignee: Terex GB Limited, Dungannon (GB)

( * ) Notice: Subject to any disclaimer, the term of this patent is extended or adjusted under 35 U.S.C. 154(b) by 736 days.

(21) Appl. No.: 15/372,801

(22) Filed: Dec. 8, 2016

(65) Prior Publication Data

US 2017/0165677 A1 Jun. 15, 2017

(30) Foreign Application Priority Data

Dec. 9, 2015 (GB) ..... 1521689.8

(51) Int. Cl.

| | |
|---|---|
| ***B02C 1/02*** | (2006.01) |
| ***B02C 23/04*** | (2006.01) |
| ***B02C 13/31*** | (2006.01) |
| ***B02C 21/02*** | (2006.01) |
| ***B02C 19/00*** | (2006.01) |
| *B02C 18/16* | (2006.01) |

(52) U.S. Cl.

CPC ..... *B02C 23/04* (2013.01); *B02C 13/31* (2013.01); *B02C 19/0018* (2013.01); *B02C 21/02* (2013.01); *B02C 2018/168* (2013.01)

(58) Field of Classification Search

CPC ..... B02C 23/04; B02C 13/31; B02C 19/0018; B02C 21/02; B02C 2018/168

See application file for complete search history.

(56) References Cited

U.S. PATENT DOCUMENTS

| | | | | |
|---|---|---|---|---|
| 3,861,604 A | | 1/1975 | Nobelius | |
| 4,398,674 A | | 8/1983 | Dreman | |
| 4,880,172 A | * | 11/1989 | Heinemann | B02C 4/426 241/101.2 |

(Continued)

FOREIGN PATENT DOCUMENTS

GB 2524273 A 9/2015

OTHER PUBLICATIONS

UK Search Report, dated Jun. 17, 2016, for UK patent application GB 1521689.8, filed on Mar. 18, 2014.

(Continued)

*Primary Examiner* — Omar Flores Sanchez

(74) *Attorney, Agent, or Firm* — Warner Norcross + Judd LLP

(57) ABSTRACT

A material processing device has a rotor coupled to a rotatable shaft, and a rotor control system. The rotor control system comprises a rotor control mechanism with a first engagement member that is engagable with a second engagement member coupled to the shaft. The rotor control mechanism is operable into and out of an engaged state in which the first and second engagement members are engaged with one another. In the engaged state, the rotor control mechanism is operable in a locking mode in which the first engagement member is fixed in position to prevent rotation of the shaft, or in a rotation mode in which the first engagement member is movable to rotate the shaft. The material processing device may be a crusher, a shredder or a milling machine.

21 Claims, 8 Drawing Sheets

(56) References Cited

U.S. PATENT DOCUMENTS

| | | | | |
|---|---|---|---|---|
| 5,553,796 | A * | 9/1996 | Bettenworth | B02C 4/426 241/230 |
| 7,628,347 | B2 * | 12/2009 | Frangenberg | B02C 4/02 241/231 |
| 10,232,380 | B2 * | 3/2019 | Knecht | B02C 4/28 |
| 2008/0017052 | A1 * | 1/2008 | Splinter | B02C 4/28 100/155 R |
| 2008/0217451 | A1 * | 9/2008 | Frangenberg | B02C 4/02 241/227 |
| 2011/0278386 | A1 * | 11/2011 | Schwamborn | B02C 15/02 241/37.5 |
| 2013/0327112 | A1 * | 12/2013 | Charre | B21B 31/103 72/237 |
| 2015/0266027 | A1 | 9/2015 | Hamilton et al. | |
| 2018/0243746 | A1 * | 8/2018 | Udy | B02C 23/04 |
| 2018/0326426 | A1 * | 11/2018 | Knecht | B02C 4/28 |

OTHER PUBLICATIONS

European Search Report, dated Mar. 31, 2017, for EP patent application EP 16199948, a foreign counterpart to U.S. Appl. No. 15/372,801.

* cited by examiner

MATERIAL PROCESSING APPARATUS WITH ROTOR CONTROL SYSTEM

FIELD OF THE INVENTION

The present invention relates to material processing apparatus. The invention relates particularly, but not exclusively, to crushers.

BACKGROUND TO THE INVENTION

Some material processing apparatus include a rotor to which an operator may be exposed, particularly during maintenance, thereby risking injury or death. For example, an impact crusher includes a rotatable drum spaced apart from a crushing wall. In use, the rotating action of the drum bounces rocks against the crushing wall until they are small enough to fit through a gap beside the drum. If the crusher jams the operator has to open the crusher to clear the jam. Should the drum rotate when the crusher is open, rocks may be flung from the crusher causing injury, or the operator may become trapped by the drum. In some instances, it is necessary to manually rotate the drum in order to free a blockage or for other maintenance purposes, e.g. replacing a wearable component such as a blade. Operators have been known to stand on the drum to try to rotate it with their weight and this may result in injury or death.

It would be desirable therefore to provide an apparatus in which unwanted rotation of the rotor is prevented while still allowing purposeful rotation.

SUMMARY OF THE INVENTION

From a first aspect the invention provides a material processing apparatus comprising:

a material processing device comprising a rotor coupled to a rotatable shaft for rotation about a rotational axis; and a rotor control system, the rotor control system comprising

- a rotor control mechanism having a first engagement member, and
- a second engagement member coupled to said shaft for rotation with said shaft, wherein said rotor control mechanism is operable into and out of an engaged state in which said first and second engagement members are engaged with one another, and wherein, in said engaged state, said rotor control mechanism is operable in a locking mode in which said first engagement member is fixed in position to prevent rotation of said shaft, or in a rotation mode in which said first engagement member is movable to rotate said shaft.

Preferably, said rotor control mechanism includes an actuator coupled to said first engagement member and operable to move said first engagement member to rotate said shaft in the rotation mode. Said actuator may be a linear actuator operable to move said first engagement member linearly, preferably along an axis that, at least when said rotor control mechanism is in said engaged state, is perpendicular to said rotational axis.

The rotor control mechanism typically includes a body that carries the actuator and first engagement member. The actuator may have first and second parts that are linearly extendible, one of the parts being fixed to the body and the other part being movable with respect to the body so that extension and retraction of the actuator causes the movable part to move linearly with respect to the body, and wherein said first engagement member is coupled to said movable part. Typically, the actuator comprises a ram, preferably a hydraulic ram, comprising a piston housing and piston rod that is extendible and retractable with respect to the piston housing.

The rotor control mechanism preferably includes locking means operable to lock the first engagement member in position, or to unlock the first engagement member to allow it to move to rotate said shaft. The locking means may be operable to lock said actuator to prevent it from extending and/or retracting, or to allow said actuator to extend and/or retract. Typically, the actuator is a lockable actuator.

Preferably, in said locking mode, said first engagement member can be fixed in any one of a plurality of positions with respect to said second engagement member.

Said rotor control mechanism may be movable, preferably pivotably, with respect to said second engagement member into and out of said engaged state.

Typically, said rotor control mechanism is coupled to a support and is movable, preferably pivotably, with respect to said support into and out of said engaged state.

The apparatus may include one or more locking device operable to lock said rotor control mechanism in said engaged state.

The apparatus may include holding means, for example comprising one or more removable stop, which is operable to prevent the rotor control mechanism from reaching the engaged state from a non-engaged state.

Typically, the first and second engagement members comprise respective teeth that intermesh with each other in the engaged state. The second engagement member may comprise a gear fixed with respect to the shaft for rotation therewith. The first engagement member may comprise a toothed bar. In said engaged state, said first engagement member may serve as a rack, and said second engagement member may serve as a corresponding pinion.

The apparatus typically includes a controller for operating said rotor control mechanism between the locking mode and the rotation mode. The controller may be operable, typically by a human operator, to control the direction of movement and/or the extent of the movement of said first engagement member in the rotation mode. In preferred embodiments, the controller is configured to control the operation of said actuator. Typically, said actuator is a hydraulic actuator and said controller comprises a hydraulic circuit.

In typical embodiments the apparatus includes a drive system for rotating said shaft, said rotor control system being operable to rotate or lock said shaft separately from said drive system.

In some embodiments, said material processing device comprises a crusher, a shredder or a milling machine.

Said rotor may be rotated in use by said shaft, or said shaft may be rotated in use by said rotor.

The rotor is typically located in a material processing chamber. The rotor typically comprises a rotary operating device for operating said material processing device.

A second aspect of the invention provides a material processing device comprising a rotor coupled to a rotatable shaft for rotation about a rotational axis; and a rotor control system, the rotor control system comprising

- a rotor control mechanism having a first engagement member, and
- a second engagement member coupled to said shaft for rotation with said shaft, wherein said rotor control mechanism is operable into and out of an engaged state in which said first and second engagement members are engaged with one another, and wherein, in said engaged state, said rotor control mechanism is operable in a locking mode in which said first engagement member is fixed in position to prevent rotation of said shaft, or in a rotation mode in which said first engagement member is movable to rotate said shaft.

Further advantageous features of the invention will be apparent to those ordinarily skilled in the art upon review of the following description of a specification embodiment and with reference to the accompanying drawings.

BRIEF DESCRIPTION OF THE DRAWINGS

An embodiment of the invention is now described with reference to the accompanying drawings in which.

DETAILED DESCRIPTION OF THE DRAWINGS

Figure 1A:
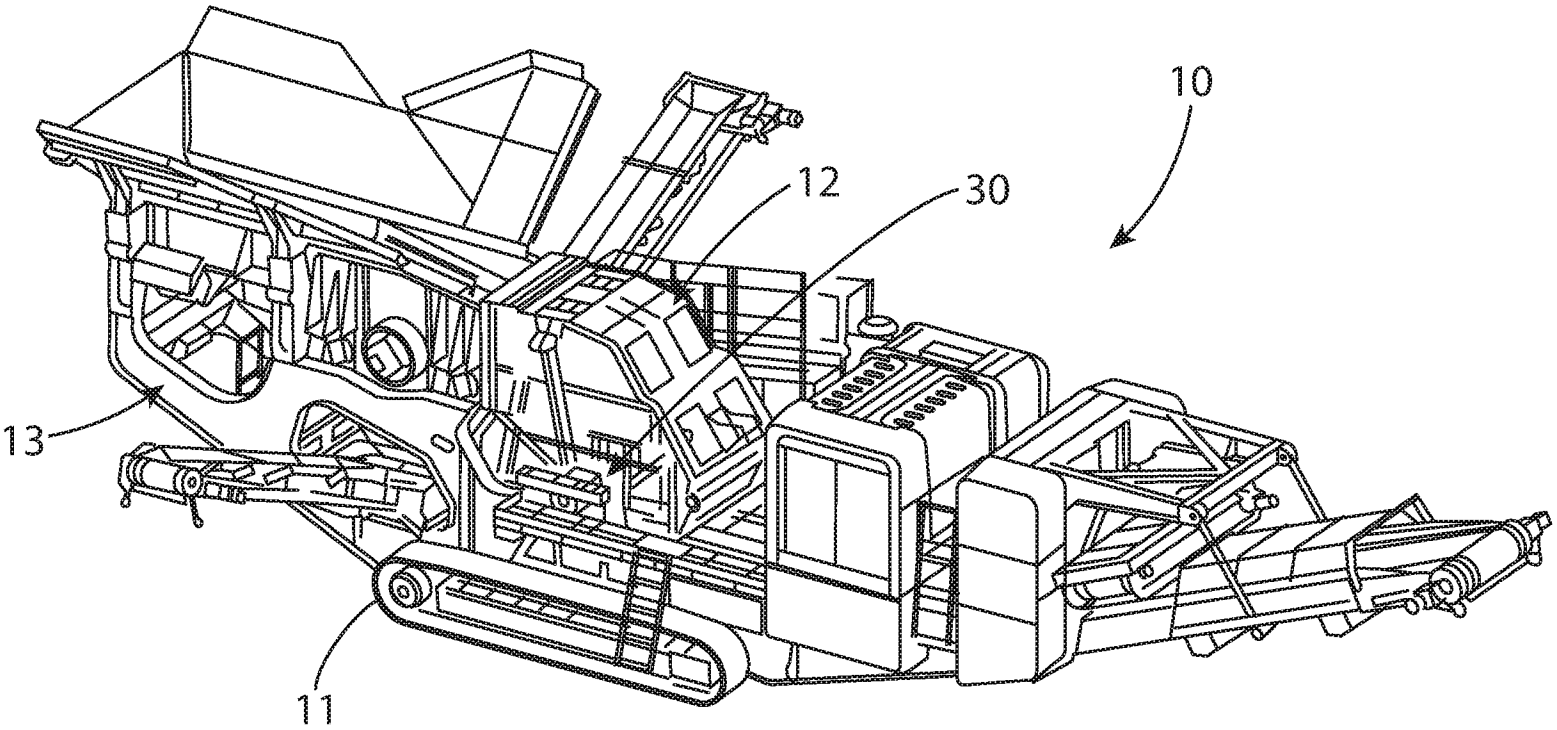
FIG. 1A is a perspective view of a material processing apparatus including a rotor control system embodying one aspect of the present invention.
Figure 1B:
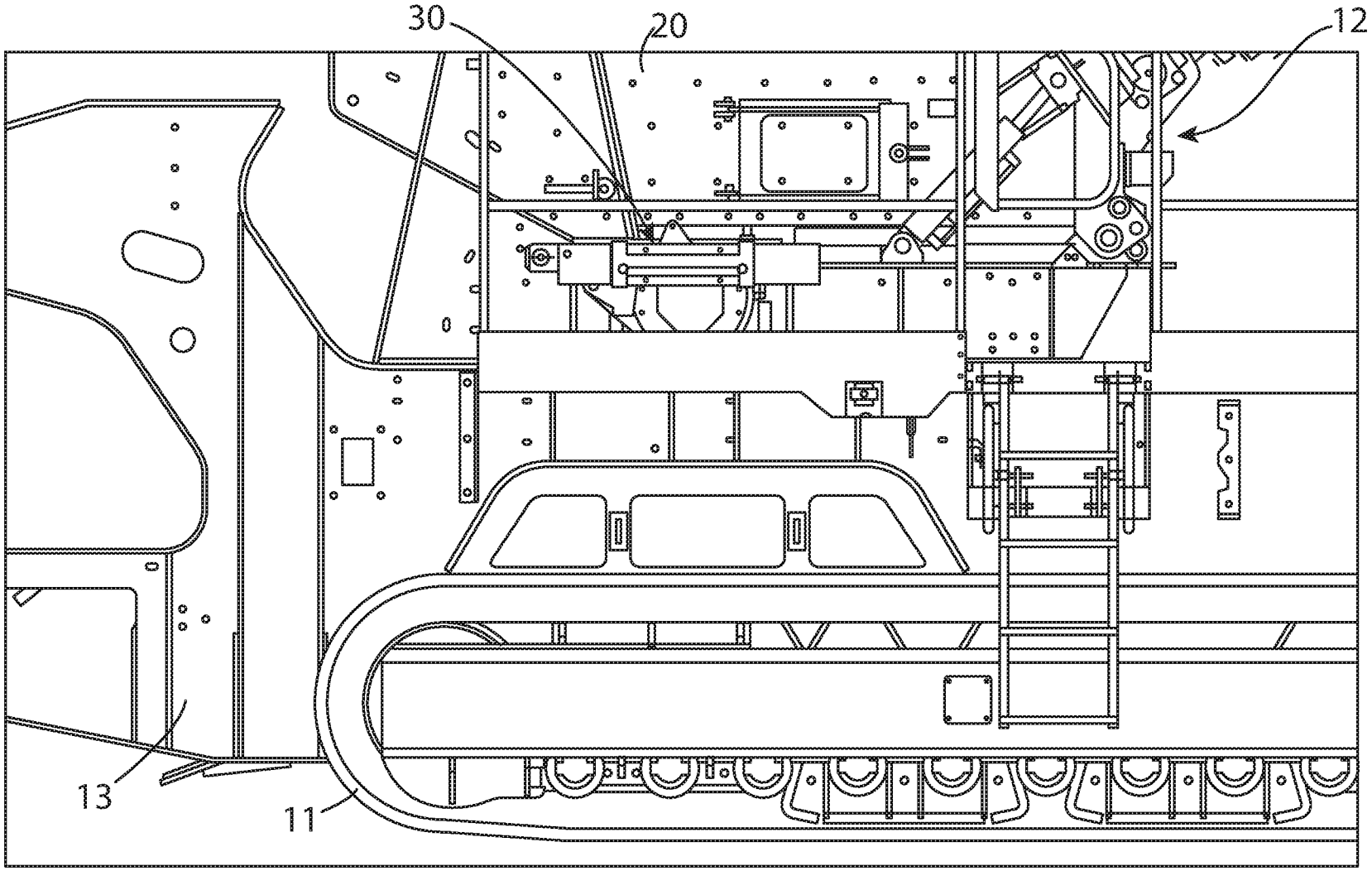
FIG. 1B is an enlarged view of part of the apparatus of FIG. 1A, showing the rotor control system.
Figure 2:
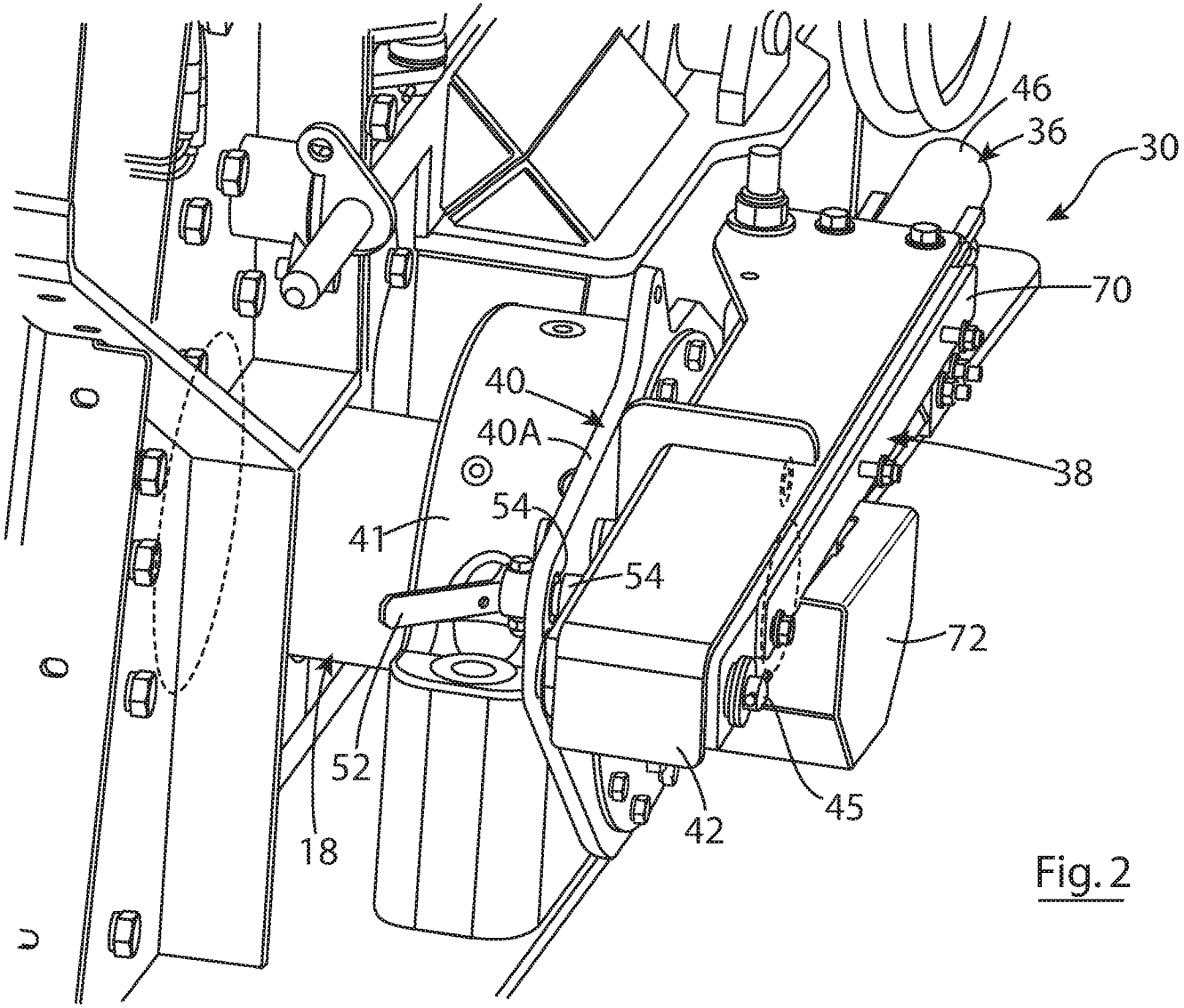
FIG. 2 is an enlarged perspective view of part of the apparatus of FIG. 1 showing the rotor control system in situ.
Figure 3:
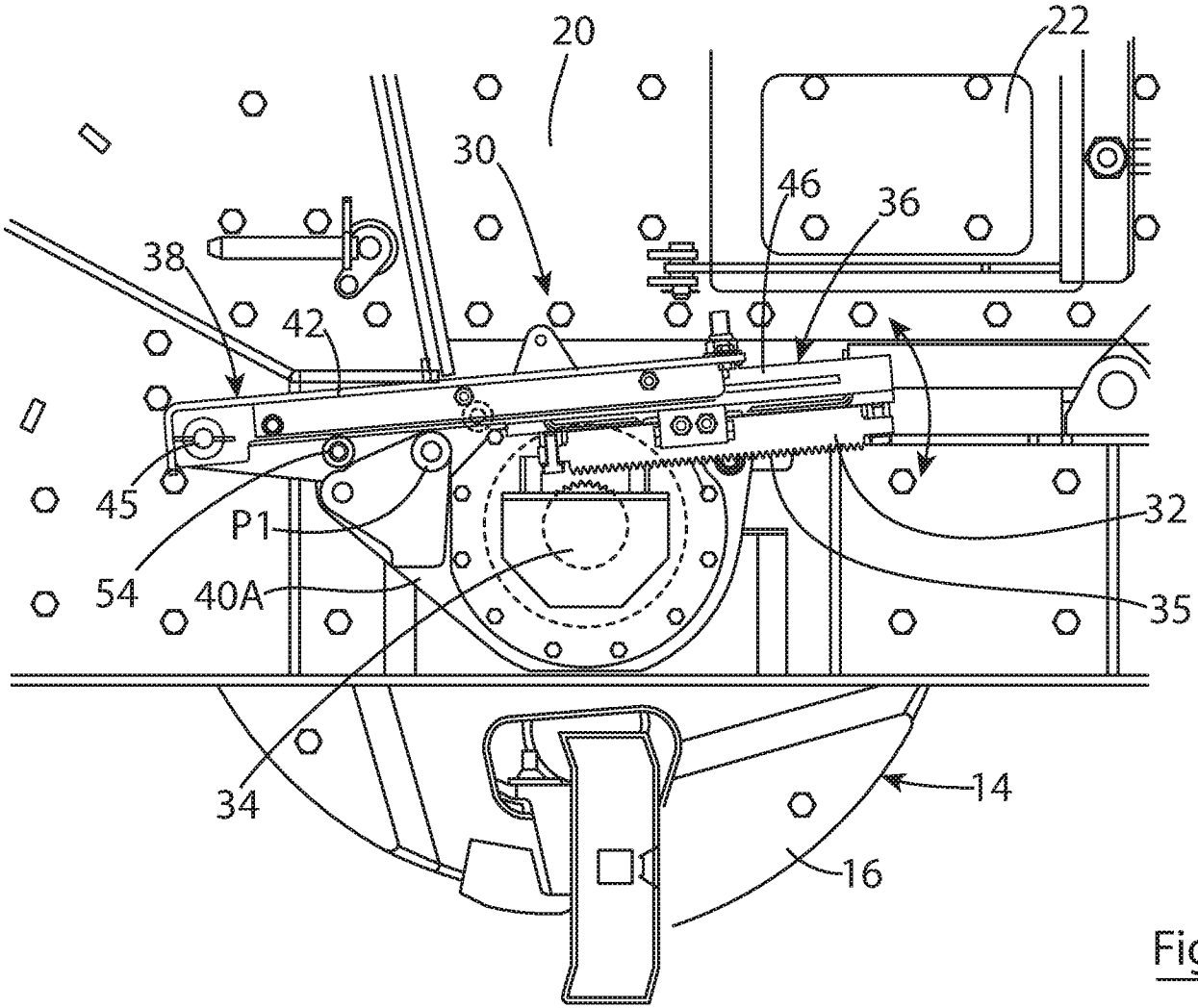
FIG. 3 is an enlarged side view of the part of the apparatus shown in FIG. 2, with the rotor control system shown in situ.
Figure 4:
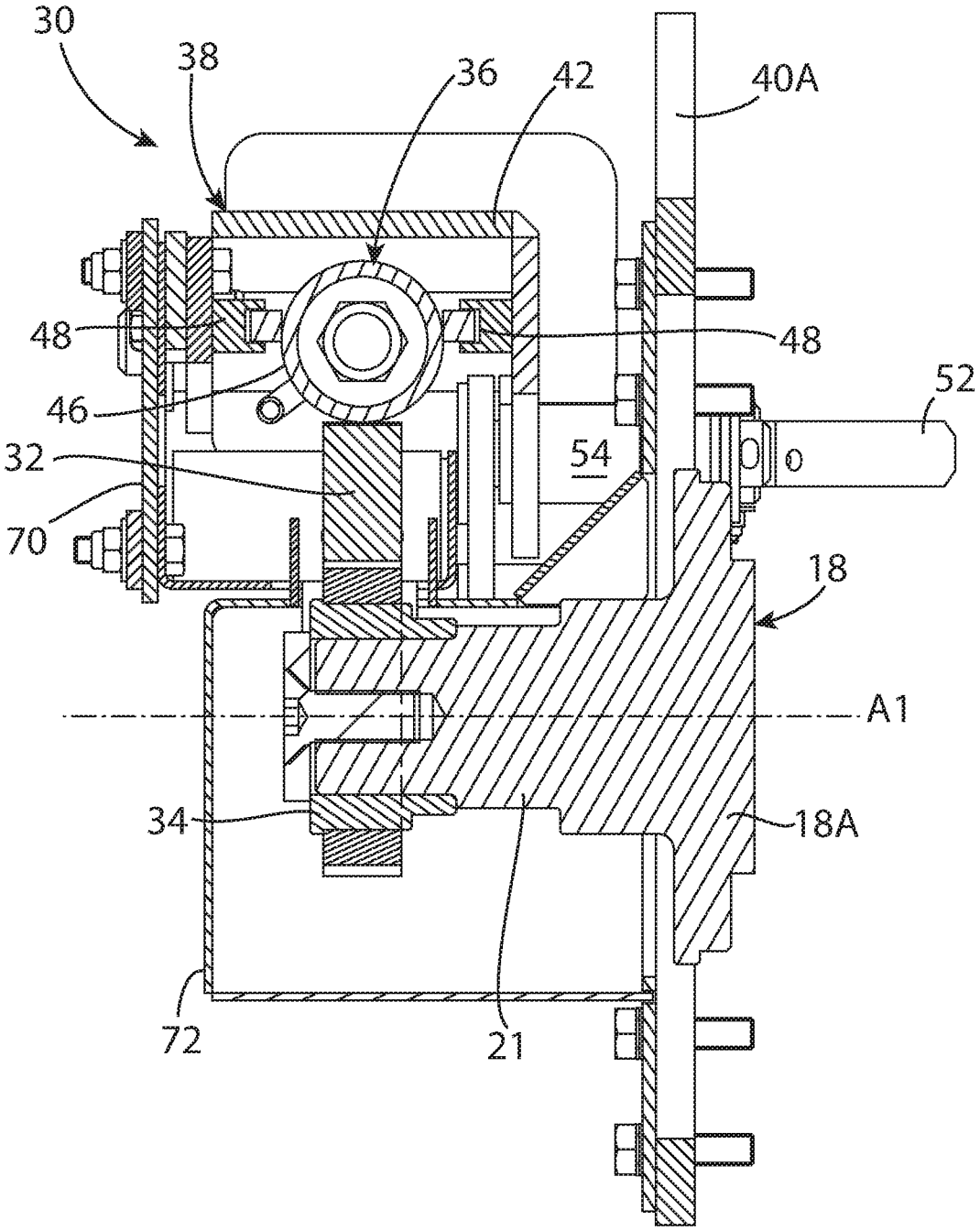
FIG. 4 is a sectioned end view of the rotor control system shown in FIGS. 1 to 3.

Referring now to the drawings, there is shown, generally indicated as 10, a material processing apparatus. Only those parts of the apparatus that are helpful for understanding the present invention are shown and described. In general, the apparatus 10 may be configured to perform any one or more of a plurality of processes, such as feeding, screening, separating, crushing, milling, waste recycling or demolition and/or washing, on one or more types of aggregate or other material, for example rocks, stones, gravel, sand and/or soil, or any other material that is quarried, mined or excavated. To this end, the apparatus may include one or more material processing device 12 configured to perform one or more of the foregoing processes. Embodiments of the invention are particularly suited for use with a variety of different types of material processing device, in particular those that include a rotor, for example crushers, shredders or milling devices. The rotor may be a material processing component, e.g. comprising a rotatable drum, or may be a rotary operating device. For example, in the case of an impact crusher, a shredder or a milling device, the rotor may comprise a rotatable drum which may have one or more blades, teeth or other formations (not shown) to facilitate the respective material processing operation, whereas in the case of a jaw crusher the rotor may comprise a rotary operating device that is rotated to effect movement of a crushing jaw. In the embodiment illustrated and described herein, the material processing device 12 is a crusher, in particular an impact crusher. It will be understood however that the invention is not limited to impact crushers or crushers in general and that the same or similar description applies to other material processing devices as would be apparent to a skilled person.

The apparatus 10 is typically but not necessarily carried by a chassis 13. The chassis 13 may also carry one or more other components (not shown) that facilitate use of the crusher 12, usually a feed assembly for delivering material to the crusher 12 and one or more conveyors for transporting crushed or uncrushed material, e.g. for the purposes of stockpiling. The feed assembly may comprise a hopper and/or a screen. In a typical arrangement, material deposited into the hopper is graded by the screen as a result of which some of the material (usually the larger pieces that do not pass through the screen) is fed to the crusher 12 while the rest bypasses the crusher 12 and is directed elsewhere, e.g. to a conveyor.

The powered components of the apparatus 10, including the crusher 12, are typically powered by a power plant which may include one or more hydraulic system comprising motor(s), actuator(s) and/or an internal combustion engine and/or other components as required. It will be understood that alternative power systems, e.g. electrical or pneumatic systems, may be used, and so the motor(s) and other components may be powered by alternative means. An electrical system may also be provided as would be apparent to a skilled person. In any event the apparatus 10 includes a power plant (not shown) for generating the requisite power (e.g. including electrical, hydraulic and/or pneumatic power as applicable) for the apparatus 10. The power plant may take any convenient conventional form, e.g. comprising any one or more of an engine, e.g. an internal combustion engine, compressor and/or batteries.

In typical embodiments, the apparatus 10 is mobile and comprises one or more wheels and/or tracks 11 mounted on the chassis 13. The apparatus 10 may be self-propelled and to this end the power plant usually comprises an internal combustion engine (not visible). In such cases, the internal combustion engine conveniently generates power for the hydraulic system(s), e.g. by operating the hydraulic pump(s) (not shown), and may also power an electric generator (not shown) for the electrical system, and/or may drive, directly or indirectly, the crusher 12.

The crusher 12 includes a rotor 14 comprising a rotatable drum 16, which may include formations (not shown) on its outer surface to facilitate crushing. The drum 16 is mounted on a rotatable shaft 18, the drum and shaft being rotatable together about an axis A1 in at least one but preferably both directions. Optionally, the shaft 18 is contained within a housing. The rotor 14 is located in a crushing chamber 20, and is rotatable within the chamber 20 about axis A1. In use, material (not shown) to be crushed is fed into the chamber 20 and, as the drum 16 rotates, the material is thrown back and forth between the drum 16 and one or more internal wall of the chamber 20 which has the effect of crushing the material. The chamber 20 may have one or more normally closed opening, for example a hatch 22, door or removable panel, which may be opened to allow access to the inside of the chamber 20, e.g. for the purposes of maintenance.

The rotor 14 is rotatable by a powered drive system (not shown) which may be powered by the power plant. The drive system may for example comprise a motor, e.g. a hydraulic motor, mounted at an end of the shaft 18 and being operable to rotate the shaft 18. Alternatively, or in addition, the drive system may comprise a motor, for example an internal combustion engine, coupled to the shaft 18 by a belt and pulley system (not shown) having a driven pulley on the rotor shaft 18 and driving pulley on the drive shaft of the motor.

The apparatus 10 includes a rotor control system 30 that is operable, when engaged, in a locking mode in which it prevents rotation of the rotor 14 about axis A1 or in a rotation mode in which it rotates the rotor 14 about axis A1. It is noted that, in the rotation mode, the rotor control system 30 rotates the rotor 14 itself without any assistance from the drive system. When the rotor control system 30 is disengaged, it allows the rotor 14 to be operated freely by the drive system.

Figure 5A:
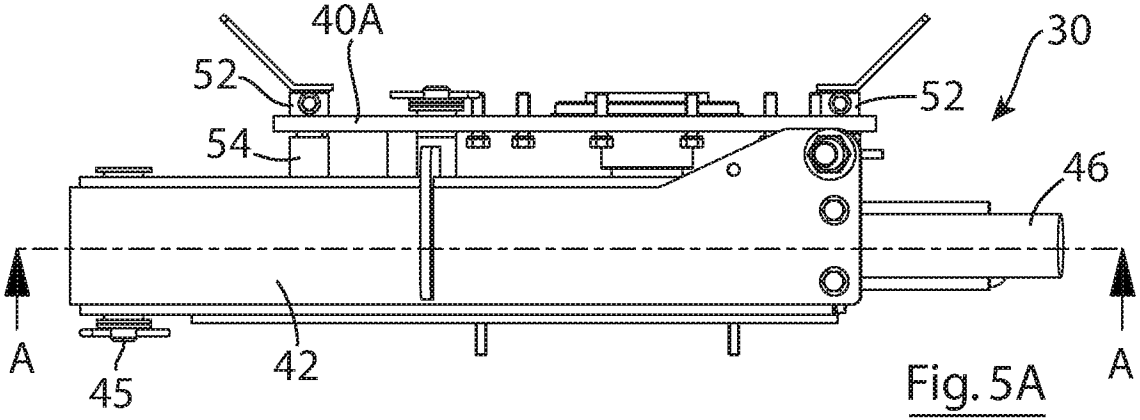
FIG. 5A is a plan view of the rotor control system shown in FIGS. 1 to 4, with a rotor control mechanism shown in a non-engaged state.
Figure 5B:
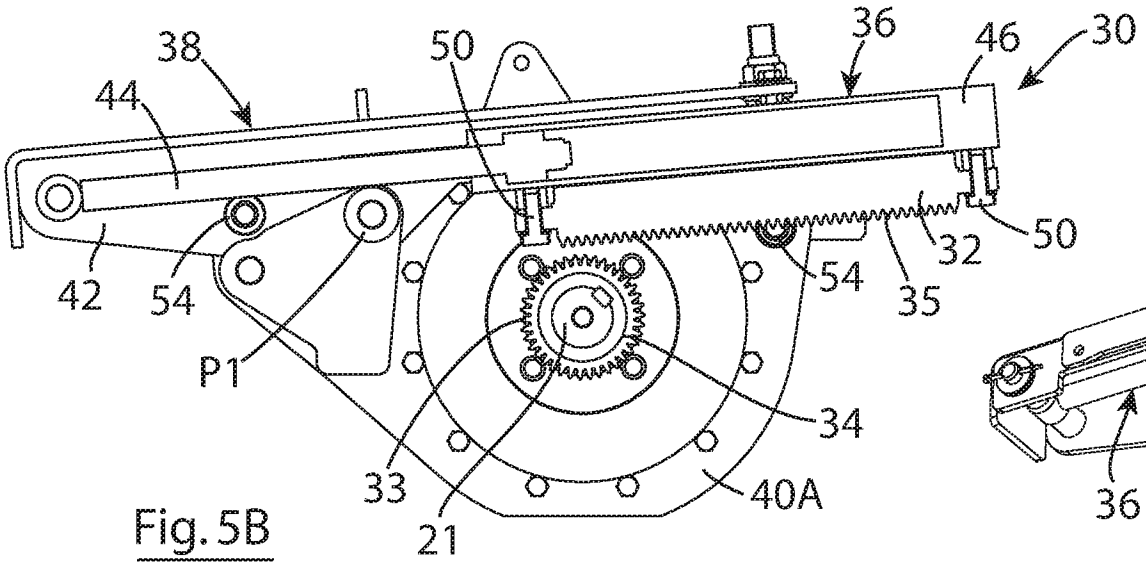
FIG. 5B is a side view of the rotor control system shown in FIGS. 1 to 4, with the rotor control mechanism shown in the non-engaged state.

The rotor control system 30 comprises a rotor control mechanism 38, which includes a first engagement member 32, a corresponding second engagement member 34 that is releasably engagable with the first engagement member 32. The rotor control mechanism 38 is operable between a non-engaged state (shown in FIGS. 5A to 5C) or an engaged state (shown in FIGS. 6 and 7). The first and second engagement members 32, 34 are engaged with one another when the control mechanism 38 is in the engaged state and disengaged when the control mechanism 38 is in the non-engaged state. When the rotor control mechanism 38 is in the engaged state, the rotor control system 30 is operable in either the locking mode or the rotation mode depending on the configuration of the rotor control mechanism, as is described in further detail below.

The second engagement member 34 is coupled to the rotor 14, conveniently via the rotor shaft 18, and is typically rotatable with the rotor 14. Preferably, the second engagement member 34 is mounted on the rotor shaft 18, conveniently at or adjacent an end 21 of the shaft 18, and is rotatable about axis A1 concentrically with the shaft 18. To this end, in preferred embodiments the end 21 projects out of the chamber 20 to facilitate interaction with the rotor control system 30. In the illustrated embodiment, a stub shaft 18A is provided at the end of the shaft 18, the engagement member 34 being provided on the stub shaft 18A.

The first engagement member 32 is movable into and out of engagement with the second engagement member 34. When engaged the engaged state is effected. In the locking mode the first engagement member 32 is held stationary, i.e. locked in position, and so prevents the second engagement member 34 from rotating, which in turn prevents the shaft 18 and rotor 14 from rotating.

In the rotation mode, the first engagement member 32 is movable with respect to the second engagement member 34 along an axis A2 which is perpendicular to the rotational axis A1 thereby rotating the second engagement member 34. The rotation control mechanism 38 includes locking means that is operable to lock the first engagement member 32 in position, i.e. preventing it from moving along the axis A2, and thus effecting the locking mode in the engaged state, or to unlock the first engagement member 32 to allow it to move along the axis A2 thereby effecting the rotation mode in the engaged state. In preferred embodiments, the first locking member 32 may be locked, i.e. fixed in position, in any position that it can adopt at or between the limits of its travel along axis A2.

The rotor control mechanism 38 includes an actuator 36, preferably a linear actuator such as a ram, coupled to the first engagement member 32. In the illustrated embodiment the actuator 36 comprises a hydraulic ram, although other types of conventional actuator may alternatively be used. The actuator 36 is operable to move the first engagement member 32 back and forth in along the axis A2.

In preferred embodiments, the second engagement member 34 comprises a gear. In the illustrated embodiment, the second engagement member 34 comprises a ring gear fitted around, and fixed with respect to, the rotor shaft 18. Typically, the first engagement member 32 includes teeth 35 that intermesh with the teeth 33 of the second engagement member 34 in the engaged state. In the locking mode, the engagement of the respective teeth 33, 35 prevent the shaft 18 and rotor 14 from rotating since the first engagement member is stationary, i.e. locked. In the rotation mode, the engaged teeth 33, 35 facilitate relative movement between the engagement members 32, 24. In preferred embodiments, the first engagement member 32 comprises a toothed, and typically rectilinear, bar which serves as a rack when engaged with the second engagement member 34, the latter serving as the corresponding pinion. In the preferred embodiment the first engagement member 32 is movable by the actuator 36 linearly along the axis on which its teeth are arranged. In any event, when the first and second engagement members 32, 34 are engaged, they serve as a rack and pinion mechanism whereby movement of the first engagement member 32 (the rack) along the axis A2 causes rotation of the second engagement member 34 (the pinion) about axis A1, the direction of rotation of the pinion depending on the sense (back or forth) of the movement of the rack.

In preferred embodiments, the rotor control mechanism 38 is movable with respect to the second engagement member 34 into and out of the engaged state. To this end, the rotor control mechanism 38 is movably coupled to a support 40. Conveniently the rotor control mechanism 38 is pivotably coupled to the support 40, at pivot P1 in the illustrated example. The support 40 may comprise a structure, such as a plate or frame, which is mounted in use on the apparatus 10, or may be provided by any convenient part of the apparatus 10 itself. In the illustrated example, the support 40 comprises a plate 40A that is mounted on a bearing mount 41 for the shaft 18. The plate 40A includes an aperture through which the shaft 18, or at least the stub shaft 18A, projects. In any event, the rotor control mechanism 38 is movable, preferably pivotably, with respect to the shaft 18 between the engaged and non-engaged states. This movement of the rotor control mechanism 38 may be effected manually by an operator (not shown) or by one or more actuators (not shown) as desired. In alternative embodiments (not illustrated) the rotor control mechanism may be configured such that only the first engagement member 32 is movable into and out of the engaged state.

In preferred embodiments, the rotor control mechanism 38 includes a body 42 that carries the actuator 36 and first engagement member 32. The body 42 is movably coupled to the support 40, preferably pivotably, at pivot P1 in the illustrated example. The preferred actuator 36 comprises a linear actuator having first and second parts 44, 46 that are linearly extendible with respect to each other between extended and retracted states. One of the parts 44 is fixed to the body 42 and the other 46 is movable with respect to the body 42 so that extension and retraction of the actuator 36 causes the movable part 46 to move back and forth along axis A2 with respect to the body 42. The movable part 46 may be movably coupled to the body 42, e.g. by a slide or bearing 48, to support and guide movement of the part 46 with respect to the body 42. The first engagement member 32 is coupled to the actuator 36 such that retraction and extension of the actuator 36 causes the first engagement member to move back and forth along the axis A2. Conveniently, the first engagement member 32 is carried by the movable part 46 of the actuator 36. In preferred embodiments, the actuator 36 comprises a ram, for example a hydraulic ram, and the extendible parts 44, 46 comprise a piston rod and a piston housing respectively. In this example, the free end of the piston rod 44 is fixed to the body 42, and the piston housing 46 is slidably coupled to the housing by a slide mechanism 48, the first engagement member 32 being carried by the piston housing 46. The first engagement member 32 may be fixed to the piston housing 46 (or other actuator part) by bolts 50 or any other convenient fixing. In the illustrated example, the free end of the piston rod 44 is fixed to the body 42 by pin 45 although any other suitable conventional fixing may be used instead.

Figure 6:
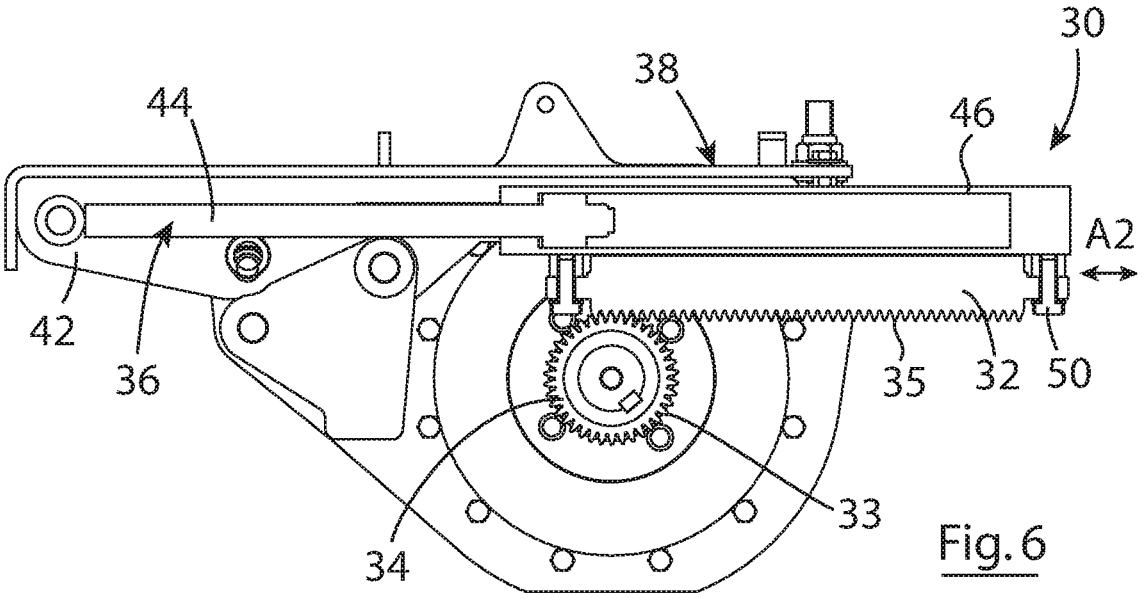
FIG. 6 is a side view of the rotor control system shown in FIGS. 1 to 4, with the rotor control mechanism shown in an engaged state.
Figure 7:
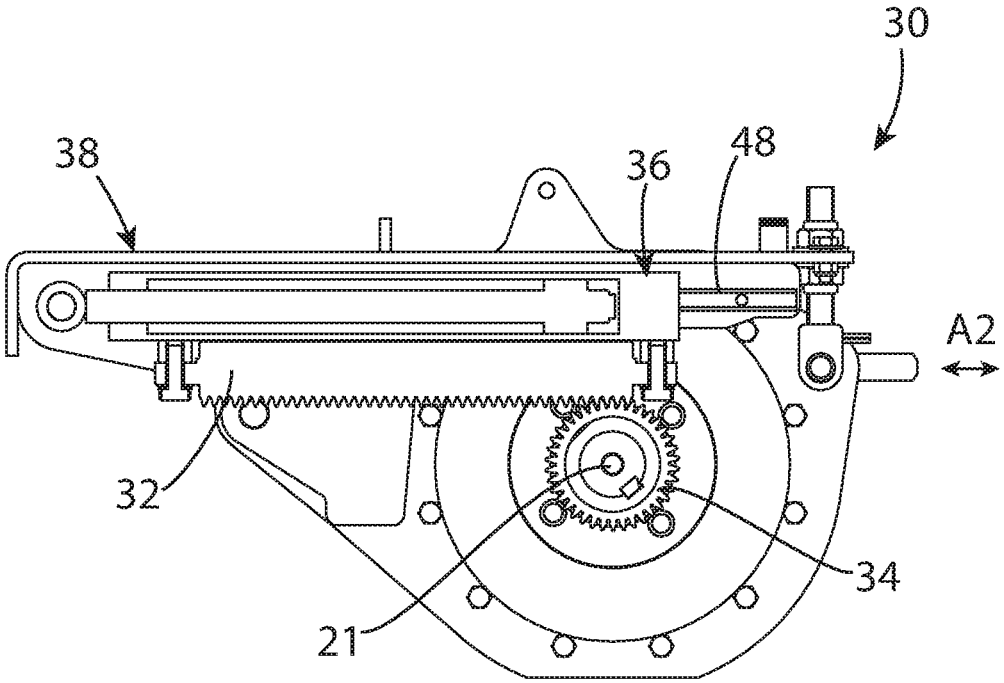
FIG. 7 is an alternative side view of the rotor control system shown in FIGS. 1 to 4, shown in the engaged state.

FIGS. 6 and 7 show the actuator 36 in its fully extended and fully retracted states respectively, and therefore show the first engagement member 32 at its respective travel limit in each direction along axis A2. The distance movable by the first engagement member 32 between its travel limits, and therefore the amount of corresponding rotation imparted to the second engagement member 34, is determined by the length of the stroke of the actuator 36. The preferred arrangement is such that the first engagement member 32 is able to rotate the second engagement member 34 through at least 360°, preferably in both rotational directions.

Figure 5C:
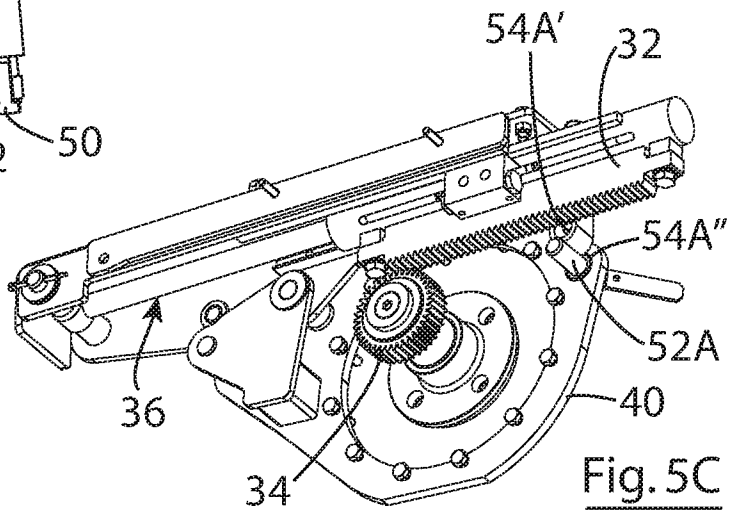
FIG. 5C is a perspective view of the rotor control system shown in FIGS. 1 to 4, with the rotor control mechanism shown in the non-engaged state.

Preferably, one or more locking devices are provided for releasably locking the rotor control mechanism 38 in the engaged state. For example one or more locking pins 52 may be provided, with corresponding pin sockets 54 formed in the support 40 and body 42 such that the respective pin 52 prevents relative movement between the support 40 and body 42 when inserted in the respective sockets 54. It is also preferred to provide means for holding the rotor control mechanism 38 out of the engaged state when not in use. Conveniently, the holding means comprises one or more removable stop, or other holding device, that prevents the rotor control mechanism 38 from reaching the engaged state from the non-engaged state. In the illustrated embodiment, locking pin 52A serves to lock the rotor control mechanism 38 in the engaged state by insertion in corresponding sockets 54A', 54A" provided on the body 42 and support 40 respectively, but when inserted through socket 54A" when the rotor control mechanism 38 is in the non-engaged state, alternatively serves as a stop for preventing the rotor control mechanism 38 from adopting the engaged state by engaging with the body 42, as can be seen in FIG. 5C.

Figure 8:
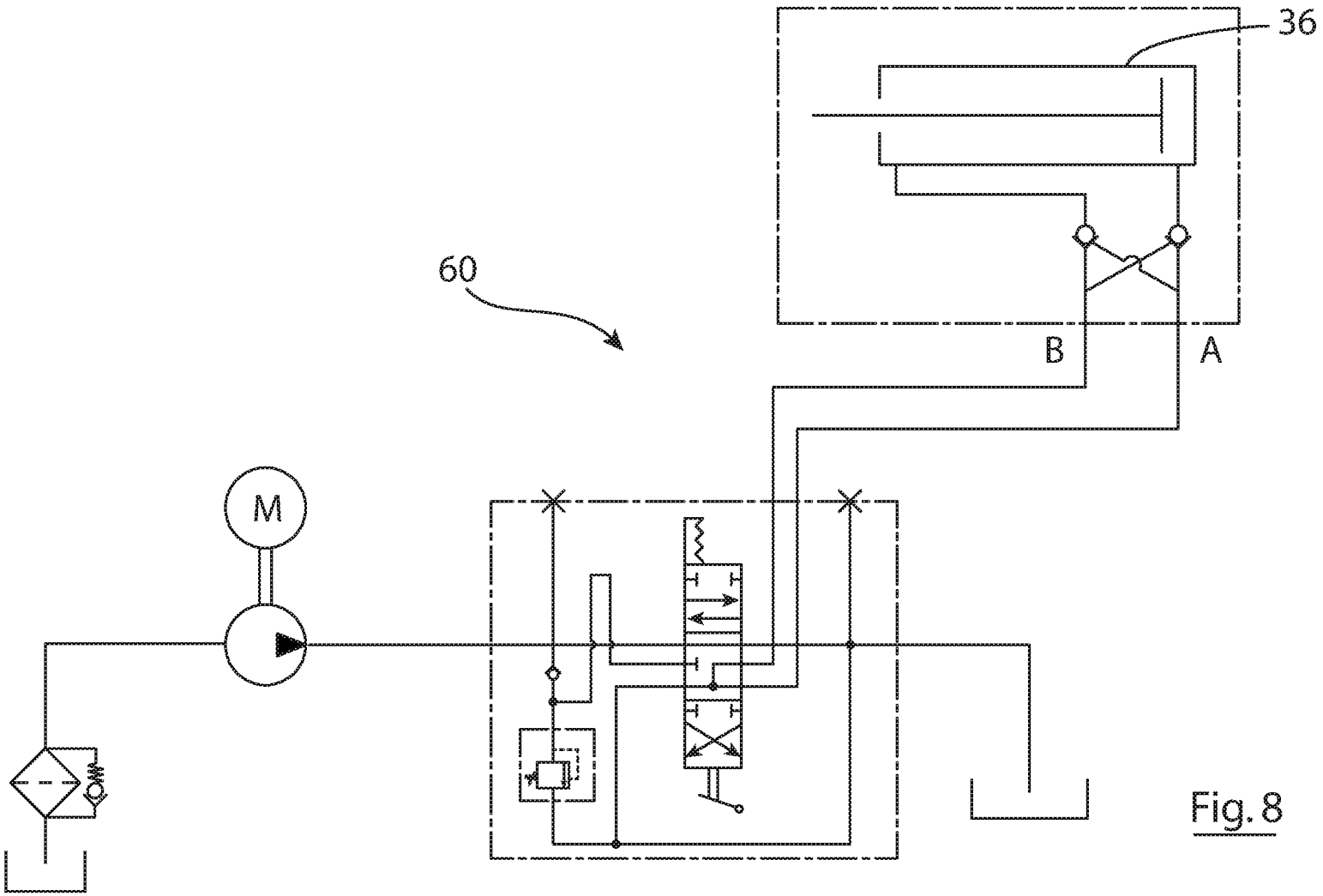
FIG. 8 is a schematic view of a hydraulic circuit suitable for operating the rotor control system shown in FIGS. 1 to 4.

The locking means for releasably locking the second engagement member 34 in position, thereby determining whether the locking mode or rotational mode is adopted may be implemented in any convenient conventional manner, e.g. by any suitable locking device. For example one or more removable locking pins and corresponding pin sockets (not illustrated) may be provided for preventing (when inserted) or permitting (when not inserted) extension and retraction of the actuator 36. In preferred embodiments, the locking means is provided by using a lockable actuator as actuator 36, i.e. an actuator that is operable in a locked mode in which it cannot extend or retract (the actuator being extendible or retractable when not in the locked mode). For example, in typical embodiments wherein the actuator 36 comprises a hydraulic ram, the ram may be operated by a hydraulic circuit 60 configured to support a locked mode (as well as extend and retract modes). FIG. 8 shows an example of a suitable hydraulic circuit 60. The arrangement may be such that, in the locked mode, hydraulic fluid of sufficient pressure is supplied to both the extend port A and the retract port B of actuator 36 simultaneously to prevent extension or retraction, or in which a respective check valve is provided for the extend port A and the retract port B that, in the locked mode, fluid is prevented from leaving the piston housing by either port A, B thereby preventing extension or retraction. In the example of FIG. 8, the circuit 60 includes a valve 62 that controls the flow of fluid to and from ports A and B and is operable by a lever 64 (or other operating mechanism), to cause the actuator to extend, retract or lock (e.g. the lever 64 may be biased to adopt a locking state in the absence of operator contact, and can be moved one way or another to effect extension and retraction).

In any event, the hydraulic circuit 60 serves as a controller for the rotor control mechanism 38 in that it is configured to support operation of the actuator 36 in the locked mode (which corresponds to the locking mode of the rotor control mechanism 38) or to extend or retract (which correspond to the rotation mode of the rotor control mechanism 38). In alternative embodiments, the controller may take any alternative conventional form to suit the actuator being used. In any event it is preferred that the controller includes controls (not shown) that are usable by the (human) operator to effect the locking or rotation modes as desired. In use therefore the operator may move the rotor control mechanism 38 into its engaged state and then select, using the controller, either to lock the rotor 14 by operating the rotor control mechanism 38 in the locking mode, or to rotate the rotor 14 by operating the rotor control mechanism 38 in the rotation mode. In the rotation mode, the controller preferably allows the operator to control the movement of the first engagement member 32, preferably to control the direction movement (and therefore the direction of rotation of the rotor 14) and the extent of the movement. This is readily achievable by controlling the actuator 36. By way of example, in the rotation mode, the operator may use the controller to rotate the rotor 14 alternately in each rotational direction to help clear a blockage.

In use, the drive system for the crusher 12 is turned off before an operator uses the rotor control system 30. Preferably, an inter-lock system (not illustrated) is provided to prevent the drive system from working when the rotor control system is in use and vice-versa.

Optionally, one or more guards 70, 72 are provided to cover the engagement members 32, 34.

In alternative embodiments (not illustrated), for example where the processing device 12 is a jaw crusher, the rotor may be a rotary operating device e.g. a pulley or flywheel, located outside of the crushing/processing chamber, the rotary operating device typically being connected to a rotary shaft that extends into the chamber. In such embodiments, the rotor control system, and more particularly the second engagement member, may be coupled to any convenient accessible part of the shaft.

It will be apparent from the foregoing that rotary control systems embodying the invention improve the safety of rotor-based processing devices, particularly during maintenance activities, since they allow the rotor to be locked or rotated in a controlled manner.

The invention is not limited to the embodiment(s) described herein but can be amended or modified without departing from the scope of the present invention.

The invention claimed is:

1. A material processing apparatus comprising:

a material processing device comprising a rotor coupled to a rotatable shaft for rotation about a rotational axis; and a rotor control system, the rotor control system comprising a rotor control mechanism having a first engagement member, and a second engagement member coupled to said shaft for rotation with said shaft, wherein said rotor control mechanism is operable into and out of an engaged state in which said first and second engagement members are engaged with one another, and wherein, in said engaged state, said rotor control mechanism is operable in a locking mode in which said first engagement member is fixed in position to prevent rotation of said shaft, or in a rotation mode in which said first engagement member is movable to rotate said shaft, wherein said rotor control mechanism includes an actuator coupled to said first engagement member and operable to move said first engagement member to rotate said shaft in the rotation mode.

2. The apparatus of claim 1, wherein said actuator is a lockable actuator.

3. The apparatus of claim 2, wherein said actuator is a linear actuator operable to move said first engagement member linearly, preferably along an axis that, at least when said rotor control mechanism is in said engaged state, is perpendicular to said rotational axis.

4. The apparatus of claim 2, wherein the rotor control mechanism includes a body that carries the actuator and first engagement member.

5. The apparatus of claim 4, wherein the actuator has first and second parts that are linearly extendible, one of the parts being fixed to the body and the other part being movable with respect to the body so that extension and retraction of the actuator causes the movable part to move linearly with respect to the body, and wherein said first engagement member is coupled to said movable part, and wherein the actuator typically comprises a ram, preferably a hydraulic ram, comprising a piston housing and piston rod that is extendible and retractable with respect to the piston housing.

6. The apparatus of claim 1, wherein the rotor control mechanism includes a locking device operable to lock the first engagement member in position in said locking mode, or to unlock the first engagement member to allow it to move to rotate said shaft.

7. The apparatus of claim 6 wherein said locking device is operable to lock said actuator to prevent it from extending and/or retracting, or to allow said actuator to extend and/or retract.

8. The apparatus of claim 1 wherein, in said locking mode, said first engagement member can be fixed in any one of a plurality of positions with respect to said second engagement member.

9. The apparatus of claim 1, wherein said rotor control mechanism is movable with respect to said second engagement member into and out of said engaged state, and wherein the apparatus includes one or more locking device operable to lock said rotor control mechanism in said engaged state and/or a holding device which is operable to prevent the rotor control mechanism from reaching the engaged state from a non-engaged state.

10. The apparatus of claim 1, wherein said rotor control mechanism is pivotably movable with respect to said support into and out of said engaged state.

11. The apparatus of claim 1, wherein the first and second engagement members comprise respective teeth that intermesh with each other in the engaged state.

12. The apparatus of claim 1, wherein the second engagement member comprises a gear fixed with respect to the shaft for rotation therewith.

13. The apparatus of claim 1, wherein the first engagement member comprises a toothed bar.

14. The apparatus of claim 1, wherein, in said engaged state, said first engagement member serves as a rack, and said second engagement member serves as a corresponding pinion.

15. The apparatus of claim 1, including a controller for operating said rotor control mechanism between the locking mode and the rotation mode, and wherein said controller is preferably operable, optionally by a human controller, to control the direction of movement and/or the extent of the movement of said first engagement member in the rotation mode.

16. The apparatus of claim 15, wherein said controller is configured to control the operation of said actuator, and wherein, optionally, said actuator is a hydraulic actuator and said controller comprises a hydraulic circuit.

17. The apparatus of claim 1, wherein said rotor is rotated in use by said shaft, or wherein said shaft is rotated in use by said rotor.

18. The apparatus of claim 1, wherein said rotor is located in a material processing chamber.

19. The apparatus of claim 1, wherein said rotor comprises a rotary operating device for operating said material processing device.

20. A material processing apparatus comprising:

a material processing device comprising a rotor coupled to a rotatable shaft for rotation about a rotational axis; and a rotor control system, the rotor control system comprising a rotor control mechanism having a first engagement member, and a second engagement member coupled to said shaft for rotation with said shaft, wherein said rotor control mechanism is operable into and out of an engaged state in which said first and second engagement members are engaged with one another, and wherein, in said engaged state, said rotor control mechanism is operable in a locking mode in which said first engagement member is fixed in position to prevent rotation of said shaft, or in a rotation mode in which said first engagement member is movable to rotate said shaft, and wherein said rotor control mechanism is coupled to a support and is movable with respect to said support into and out of said engaged state.

21. A material processing apparatus comprising:

a material processing device comprising a rotor coupled to a rotatable shaft for rotation about a rotational axis; and a rotor control system, the rotor control system comprising a rotor control mechanism having a first engagement member, and a second engagement member coupled to said shaft for rotation with said shaft, wherein said rotor control mechanism is operable into and out of an engaged state in which said first and second engagement members are engaged with one another, and wherein, in said engaged state, said rotor control mechanism is operable in a locking mode in which said first engagement member is fixed in position to prevent rotation of said shaft, or in a rotation mode in which said first engagement member is movable to rotate said shaft, the apparatus further including a drive system for rotating said shaft, said rotor control system being operable to rotate or lock said shaft separately from said drive system.

* * * * *